US005865001A

United States Patent [19]

Martin et al.

[11] Patent Number: 5,865,001

[45] Date of Patent: Feb. 2, 1999

[54] PREFABRICATED WALL PANELS CONNECTING SYSTEM

[75] Inventors: Robert Martin, Narvon; Gary Weaver, Ephrata, both of Pa.

[73] Assignee: We-Mar, Inc., Ephrata, Pa.

[21] Appl. No.: 803,002

[22] Filed: Feb. 21, 1997

[51] Int. Cl.[6] ..... E04C 2/288

[52] U.S. Cl. ..... 52/309.12; 52/309.7; 52/309.17; 52/375; 52/405.3; 52/92.2; 52/79.9; 52/79.14; 52/284; 52/288.1; 52/590.1; 52/712

[58] Field of Search ..... 52/92.1, 92.2, 52/92.3, 93.1, 704, 712, 713, 79.14, 79.9, 284, 287.1, 288.1, 270, 271, 250, 251, 262, 276, 278, 282.3, 282.4, 718.01, 309.12, 309.17, 721.2, 721.3, 586.2, 586.1, 590.1, 477, 653.1, 300

[56] References Cited

U.S. PATENT DOCUMENTS

| | | |
|---|---|---|
| 518,292 | 4/1894 | Tickner et al. . |
| 1,124,404 | 1/1915 | Featherstone . |
| 1,129,658 | 2/1915 | Foy . |
| 1,131,479 | 3/1915 | Dale . |
| 1,238,858 | 9/1917 | Widmer . |
| 1,313,630 | 8/1919 | Galan . |
| 1,363,391 | 12/1920 | Carpenter . |
| 1,421,007 | 6/1922 | Howell . |
| 1,436,033 | 11/1922 | Hahn . |
| 1,439,281 | 12/1922 | Ambursen . |
| 1,499,572 | 7/1924 | Eldridge . |
| 1,537,278 | 5/1925 | Wilson et al. . |
| 1,592,070 | 7/1926 | Blake . |
| 1,757,763 | 5/1930 | Betzler . |
| 1,773,168 | 8/1930 | Brostrom . |
| 1,778,345 | 10/1930 | Venzie . |
| 1,834,892 | 12/1931 | Betzler . |
| 1,840,304 | 1/1932 | Branson . |
| 2,058,285 | 10/1936 | Amescua . |
| 2,111,577 | 3/1938 | Thomas . |
| 2,184,464 | 12/1939 | Myers . |
| 2,208,589 | 7/1940 | Leemhuis . |
| 2,266,007 | 12/1941 | Copeman . |
| 2,306,548 | 12/1942 | Leemhuis . |
| 2,321,813 | 6/1943 | Henzel . |
| 2,451,951 | 10/1948 | Howat . |
| 2,514,805 | 7/1950 | Seymour . |
| 2,592,634 | 4/1952 | Wilson . |
| 2,630,614 | 3/1953 | Peterson . |
| 2,723,107 | 11/1955 | Parker . |

(List continued on next page.)

FOREIGN PATENT DOCUMENTS

| | | |
|---|---|---|
| 0117205 | 8/1984 | European Pat. Off. . |
| 0392610 | 10/1990 | European Pat. Off. . |
| 610611 | 9/1926 | France . |
| 2470218 | 11/1979 | France . |
| 2832728 | 2/1980 | Germany . |
| 3801417 | 12/1988 | Germany . |
| 6606733 | 11/1966 | Netherlands . |
| 135680 | 10/1929 | Switzerland . |
| 514941 | 5/1976 | U.S.S.R. . |
| 683805 | 12/1952 | United Kingdom . |

OTHER PUBLICATIONS

Macwall Concrete Systems Brochure.

Burke—The Concrete Supermarket Brochure.

Del Zotto Mfg. Precast Concrete Wall Panels Brochure.

Machnik Precast Concrete Wall Panel, Alfred Machnik Research Report No. 78–77, Foundation System, Sep. 10, 1980.

Edwards Precast, Weather Cast Building System Brochure.

Dayton Superior Sandwich Panel Information.

Royal Wall Systems Brochure.

*Primary Examiner*—Robert Canfield

*Attorney, Agent, or Firm*—Volpe and Koenig, P.C.

[57] ABSTRACT

A connecting system for prefabricated panels for forming walls and roofs of buildings which includes a non-structural concrete corner piece for attachment between abutted prefabricated wall panels. The wall panels having geometrically configured channels for securing roof truss members with complimentary geometrically configured straps.

5 Claims, 13 Drawing Sheets

U.S. PATENT DOCUMENTS

| | | | |
|---|---|---|---|
| 2,775,019 | 12/1956 | Bemis . | |
| 2,823,426 | 2/1958 | Dunlap . | |
| 2,823,442 | 2/1958 | Miller et al. . | |
| 2,902,745 | 9/1959 | Brigard et al. . | |
| 2,924,962 | 2/1960 | Nettle . | |
| 2,993,637 | 7/1961 | Lacey . | |
| 3,146,497 | 9/1964 | Short et al. . | |
| 3,245,185 | 4/1966 | Rowe . | |
| 3,246,828 | 4/1966 | Branscum et al. . | |
| 3,295,818 | 1/1967 | Kreier, Jr. . | |
| 3,310,917 | 3/1967 | Simon . | |
| 3,317,178 | 5/1967 | Kreier, Jr. . | |
| 3,330,437 | 7/1967 | Bellamy . | |
| 3,380,703 | 4/1968 | Zastrow . | |
| 3,415,023 | 12/1968 | Lebreton . | |
| 3,434,689 | 3/1969 | Aftreth . | |
| 3,435,580 | 4/1969 | Merrill et al. | 52/405.3 |
| 3,515,779 | 6/1970 | Jones . | |
| 3,553,797 | 1/1971 | Horton . | |
| 3,638,902 | 2/1972 | Bergan . | |
| 3,885,008 | 5/1975 | Martin . | |
| 3,886,699 | 6/1975 | Bergmann, Jr. . | |
| 3,892,098 | 7/1975 | Kobori . | |
| 3,930,633 | 1/1976 | Wolf . | |
| 3,979,863 | 9/1976 | Hurley et al. . | |
| 4,017,051 | 4/1977 | Scott et al. . | |
| 4,033,545 | 7/1977 | Duwe et al. . | |
| 4,090,336 | 5/1978 | Carroll . | |
| 4,141,532 | 2/1979 | Wall . | |
| 4,159,100 | 6/1979 | Landowski . | |
| 4,163,349 | 8/1979 | Smith . | |
| 4,194,333 | 3/1980 | Paton et al. . | |
| 4,241,555 | 12/1980 | Dickens et al. . | |
| 4,291,513 | 9/1981 | Ankarswed . | |
| 4,365,453 | 12/1982 | Lowe . | |
| 4,380,887 | 4/1983 | Lee . | |
| 4,422,997 | 12/1983 | Machnik . | |
| 4,426,060 | 1/1984 | Csont . | |
| 4,432,176 | 2/1984 | Balzer . | |
| 4,494,353 | 1/1985 | Lewis . | |
| 4,512,126 | 4/1985 | Walston . | |
| 4,532,745 | 8/1985 | Kinard . | |
| 4,542,613 | 9/1985 | Leyte-Vidal | 52/375 |
| 4,554,124 | 11/1985 | Sudrabin . | |
| 4,570,398 | 2/1986 | Zimmerman . | |
| 4,605,529 | 8/1986 | Zimmerman . | |
| 4,619,032 | 10/1986 | Sudrabin . | |
| 4,624,089 | 11/1986 | Dunker . | |
| 4,641,468 | 2/1987 | Slater . | |
| 4,751,803 | 6/1988 | Zimmerman . | |
| 4,815,243 | 3/1989 | Pardo . | |
| 4,841,702 | 6/1989 | Huettemann . | |
| 4,862,660 | 9/1989 | Raymond . | |
| 4,934,121 | 6/1990 | Zimmerman . | |
| 4,947,600 | 8/1990 | Porter . | |
| 4,974,381 | 12/1990 | Marks . | |
| 5,055,252 | 10/1991 | Zimmerman . | |
| 5,313,753 | 5/1994 | Sanger . | |
| 5,381,635 | 1/1995 | Sanger . | |
| 5,588,272 | 12/1996 | Haponski | 52/405.3 X |
| 5,697,189 | 12/1997 | Miller et al. | 52/405.3 X |

PREFABRICATED WALL PANELS CONNECTING SYSTEM

BACKGROUND OF THE INVENTION

1. Field of the Invention

The present invention relates generally to the field of prefabricated concrete wall construction, and more specifically, to a prefabricated wall connection system. The system includes structural wall panels that have a bolting system for adjoining adjacent wall panels, non-structural concrete corner pieces having metal connecting straps for securing them to the structural wall panels and straps for securing roof truss sections.

2. Description of Related Art

In response to problems with traditional block construction methods, prefabricated wall panels were developed for rapid construction of buildings. Prefabricated wall panels of this type are shown in U.S. Pat. Nos. 4,751,803, 4,934,121, 5,055,252 and 5,313,753. Typically, these prefabricated wall panels are formed by pouring concrete into a frame that includes concrete or wooden members which are arranged to form the studs of a rectangular wall structure. In some systems, insulating materials are placed in or are integrated with the wall panel structure.

While these prefabricated wall panels are superior to traditional block construction in terms of cost, performance and reliability, methods for connecting the panels to each other or to other building members are less than acceptable. Prior art methods for connecting prefabricated panels are often unsightly and can result in decreased structural strength. The prior art prefabricated wall structures do not provide the desired properties of high strength, maximum insulating properties, single pour formation, with solid, easy to use anchoring means for adjacent walls and supported roof structures.

SUMMARY OF THE INVENTION

The present invention relates to a wall system utilizing prefabricated wall panels. The panels include a base concrete beam, vertical concrete studs interlocked with and spaced along the base beams, and a concrete top beam interlocked with the top ends of the vertical studs. There is at least one geometrically configured channel in each top beam. Straps a with complimentary geometrically configured end join the wall panels to roof truss members. Rigid insulation is attached to the outside edge of the concrete studs by the fasteners attached to the edges of the concrete studs. A layer of poured concrete is attached to the surface formed by the insulation and encloses the insulation and the fasteners.

The present invention also contemplates the inclusion of non-structural corner pieces for use in the prefabricated wall system.

DETAILED DESCRIPTION OF THE PREFERRED EMBODIMENT

The invention will be described with reference to drawing figures wherein like numerals represent like elements throughout.

Figure 1:
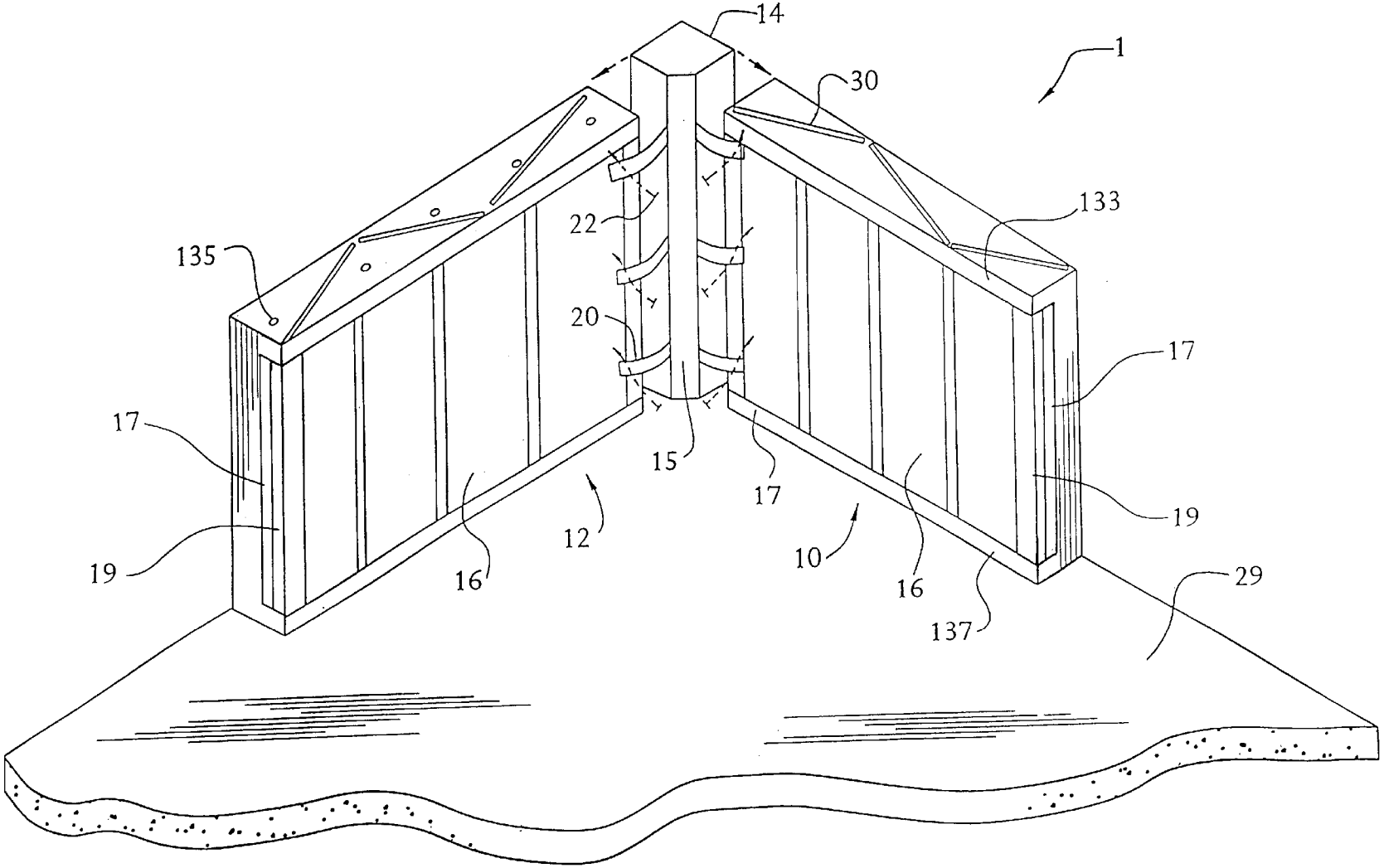
FIG. 1 is a perspective view of a wall panel connection system in accordance with the teachings of the present invention.

Referring to FIG. 1, there is shown an integrated prefabricated concrete wall system 1 made in accordance with the teachings of the present invention. The wall system 1 includes a plurality of prefabricated concrete wall panels 10, 12, a prefabricated concrete corner finishing piece 14, and a supporting concrete slab 29. Slab 29 is typically six to twelve inches (6"–12") in thickness. The thickness of the slab 29 varies depending on the size of the finished structure and the makeup of the underlying ground support. Slab construction techniques are known in the art and are very common in the Southern part of the United States.

Figure 2:
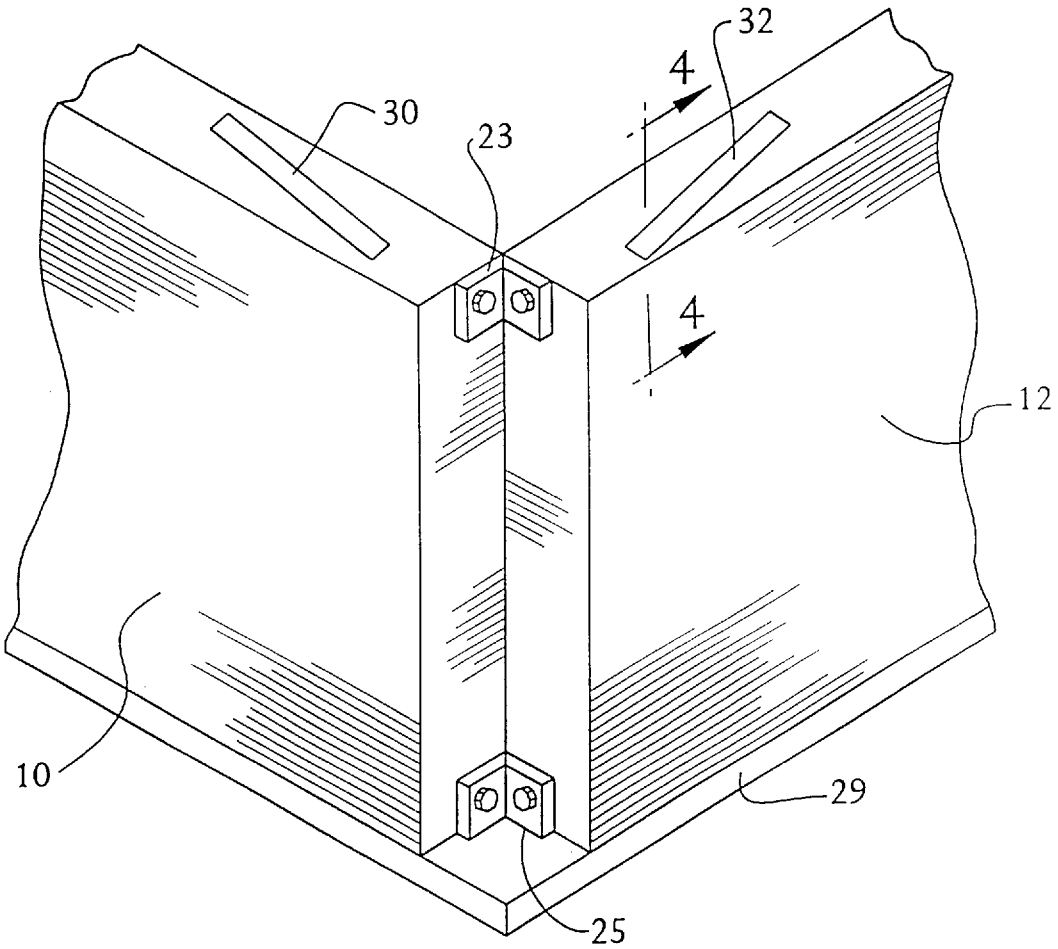
FIG. 2 is a perspective view of the wall panel corner connection system without the finishing corner piece.

As shown in FIG. 1, the concrete corner piece 14 has a plurality of metal fastening straps 20 projecting from the surface 15. In the final construction, wall panels 10 and 12 are closely abutted and connected to provide a stable corner connection for the structure as shown in FIG. 2. When abutted with the connected concrete wall panels 10 and 12, the corner piece 14 is secured by affixing the straps 20 to the interior faces of the panels 10 and 12. Concrete screws or nails 22 are used to attach the corner piece 14 to the wall panels 10 and 12.

As shown in FIG. 2, the exterior facing portions of wall panels 10 and 12 are secured together by a plurality of L-shaped base plates 23 and 25. The base plates 23 and 25 are bolted into preformed threaded portions molded in the side of wall panels 10 and 12. The preformed threaded portions are integrated into the concrete form used to construct the wall panels 10 and 12 as will be discussed in greater detail later herein.

Figure 3:
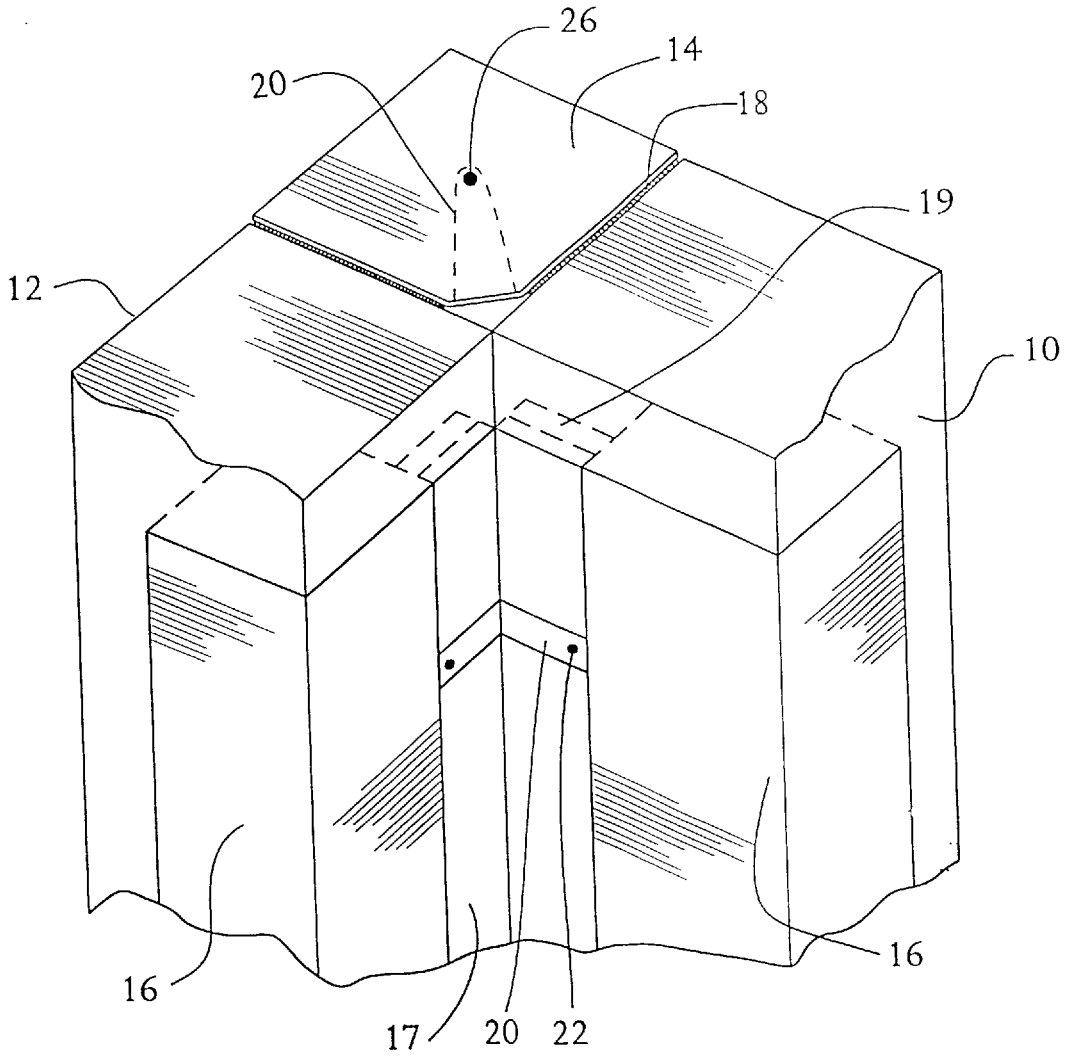
FIG. 3 is a perspective view illustrating the decorative corner piece connection system.

As shown in FIG. 3, partially in phantom, the strap 20 which secures the concrete corner piece 14 to the wall panels 10 and 12 is positioned around the vertical concrete reinforcing bar 26. This placement of the strap 20 about the reinforcing bar 26 not only secures the strap 20, but it prevents removal of the concrete corner piece 14 from the outside. As can be seen from this view, surface 15 of piece 14 is angled to permit the ends of strap 20 to be drawn through without interfering with the wall panel abutment.

Also shown in FIG. 3, wall panels 10 and 12 include insulated, preferably polystyrene, panels 16 which are placed upon the inner facing section of the wall panels 10 and 12 and abut the respective end studs 17 which meet in the corner. Each of the studs 17 has a layer of insulation 19 behind it. Cauking is provided to fill joints 18. A thermal resistivity or "R" value in the range of 10–16 is preferred for the insulating panels 16.

Figure 4:
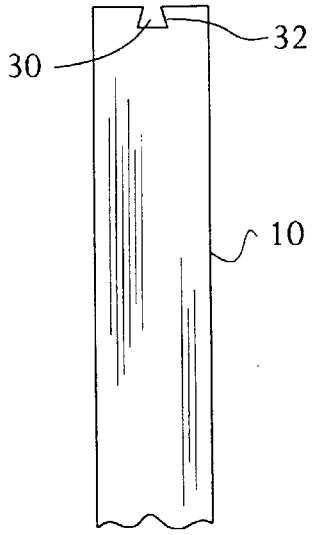
FIG. 4 is an elevation section view along the line 4—4 of FIG. 2.

As shown in FIGS. 2 and 4, the top portions of the wall panel 10 have keystone shaped channels 30. The length, number and spacing of channels 30 will be determined by the length of the wall panel and the conditions for use. In the preferred embodiment, the interior walls 32 of the channel 30 are tapered upwardly to define the trapezoid shape and channel 30 has an altitude of between one to two inches (1"–2"). Each channel 30 is situated so as to not interfere with the lift anchor bolts or the electrical conduits in the wall panel. It is preferred to have at least two channels 30 which alternate in angulation relative to the length of the wall panel to prevent any sliding of the roof truss members as will be explained hereinafter.

Figure 5:
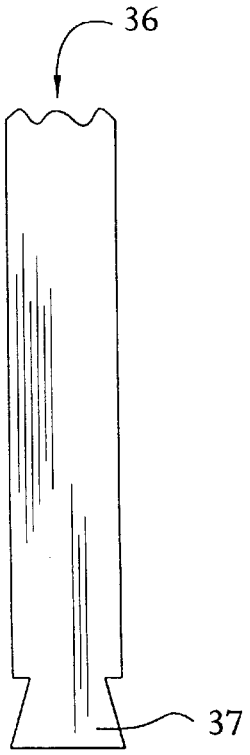
FIG. 5 is a front elevation view of a roof connecting strap for use in the slot of FIG. 4.

In FIG. 5, the front elevation of the preferred fastening strap 36 for use in the channel 30 is shown. The strap 36 has a complementary dovetail shaped section 37. During installation, strap 36 is inserted into the channel 30 and rotated to bring the end section 37 into a complimentary position within the channel 30. The fastening strap 36 is preferably galvanized steel, however, other high tensile strength materials may be used. In the preferred embodiment, strap 36 is formed to reinforce the lower edge of section 37.

Figure 6:
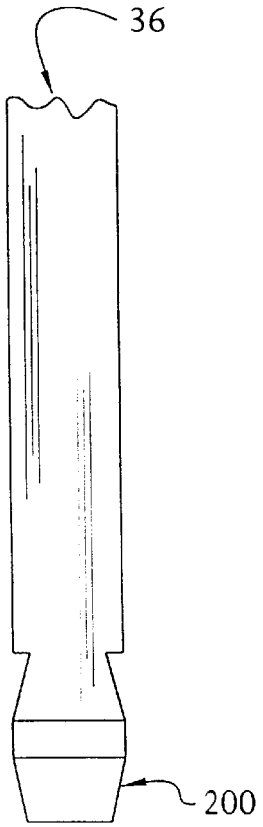
FIG. 6 is a front elevation view of a blank used to form the roof connecting strap shown in FIG. 5.
Figure 7:
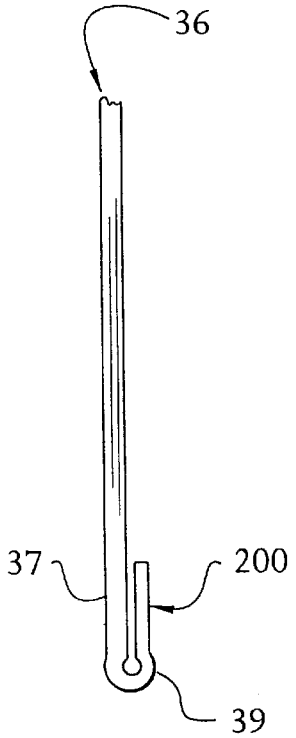
FIG. 7 is a side elevation view of the roof connecting strap of FIG. 5.

In the preferred embodiment shown in FIGS. 6 and 7, the strap 36 is stamped out to have a mirror image trapezoid portion 200. The mirror image trapezoid portion 200 is folded over as shown in FIG. 7. This allows the tubular base 39 to reinforce the lower end of the trapezoid section 37.

Figure 8:
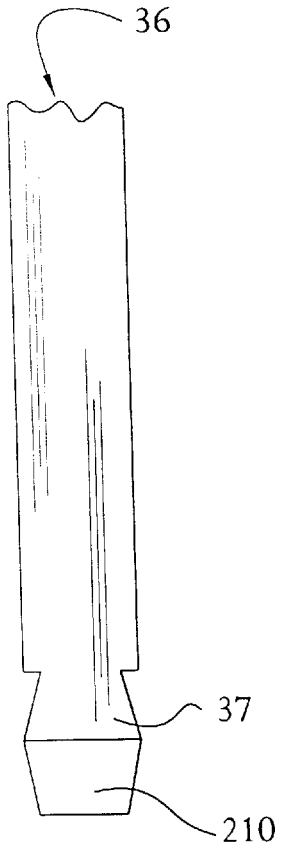
FIG. 8 is an alternate front elevation view of a blank used to form the roof connecting strap shown in FIG. 5.
Figure 9:
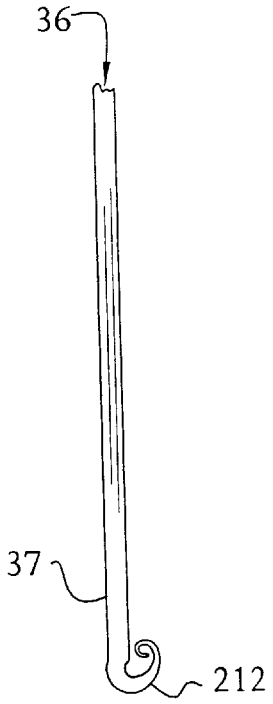
FIG. 9 is an alternate side elevation view of the roof connecting strap of FIG. 5.

In an alternative embodiment shown in FIGS. 8 and 9, the strap 36 is stamped out to have a tapered flange 210 extending from the trapezoid section 37. The tapered flange 210 is rolled upon itself to form the tubular base 212 which reinforces the lower end of the trapezoid section 37.

Figure 10:
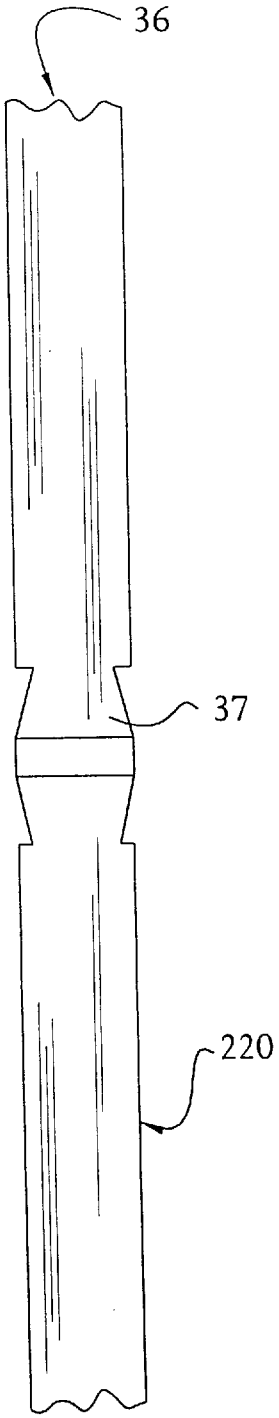
FIG. 10 is an alternate front elevation view of a blank used to form the roof connecting strap shown in FIG. 5.
Figure 11:
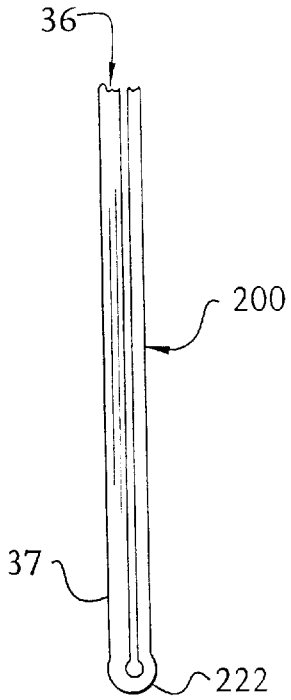
FIG. 11 is an alternate side elevation view of the roof connecting strap of FIG. 5.

In the third alternative embodiment shown in FIGS. 10 and 11, the strap 36 is stamped out to have a mirror image 220 of the entire strap. The mirror image 220 is folded over onto the strap 36 to form a tubular end 222. The tubular end reinforces the lower end of the trapezoid section 37.

Figure 12:
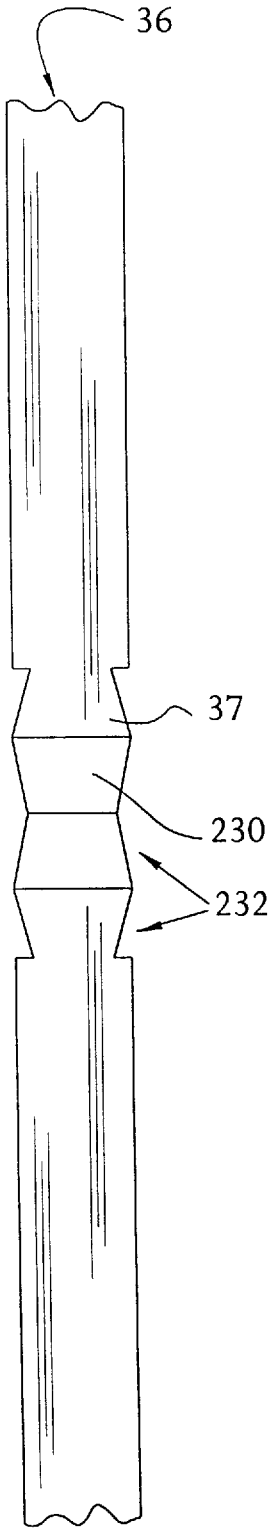
FIG. 12 is an alternate front elevation view of a blank used to form the roof connecting strap shown in FIG. 5.
Figure 13:
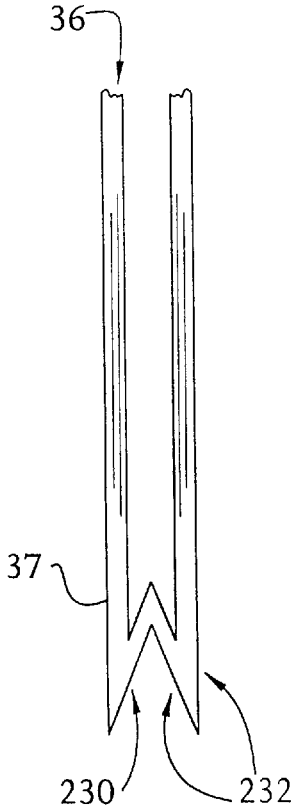
FIG. 13 is an alternate side elevation view of the roof connecting strap of FIG. 5.

As shown in FIGS. 12 and 13, the strap 36 of the fourth alternative embodiment is stamped out to have a mirror image trapezoid 230 and a further mirror image 232 of the strap 36 and the additional trapezoid 230. The mirror image 232 is folded into a substantially "W" shape to reinforce the lower end of the trapezoid section 37.

Figure 14:
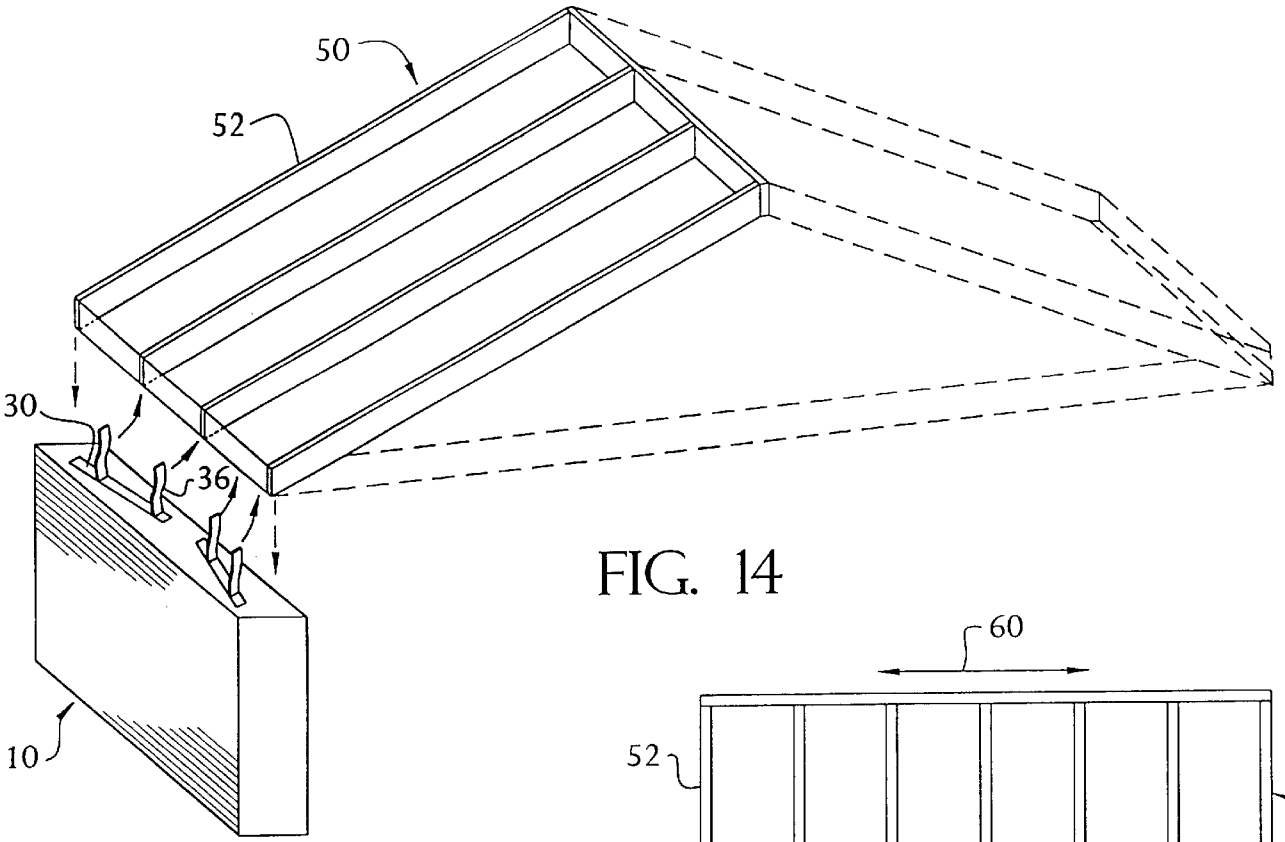
FIG. 14 is a perspective view of the roof connection system.
Figure 15:
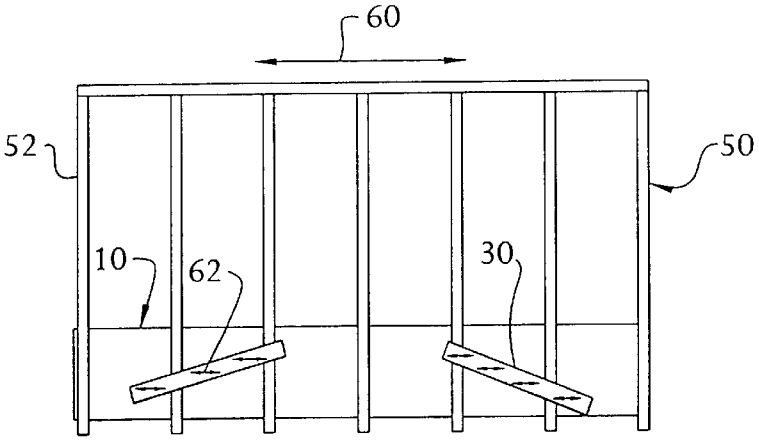
FIG. 15 is a top plan view illustrating the roof and panel connection.

As shown in FIG. 14, the fastening straps 36 will secure the roof truss member 50 to the wall panel 10. The straps 36 are fastened to the truss member 50 by a plurality of screws, nails, or other anchors. The anchors preferably are provided at one inch (1") intervals on center along the length of the strap 36. The channels 30 are angled relative to each other and the longitudinal plane of the wall panel 10 to prevent the roof truss member 50 from sliding during high wind loads. As shown in FIG. 15, the angled channels 30 resist forces applied to the roof truss member in the direction of arrows 62 as well as any force which may cause lifting or shifting in a direction perpendicular to the wall panel 10.

Figure 16:
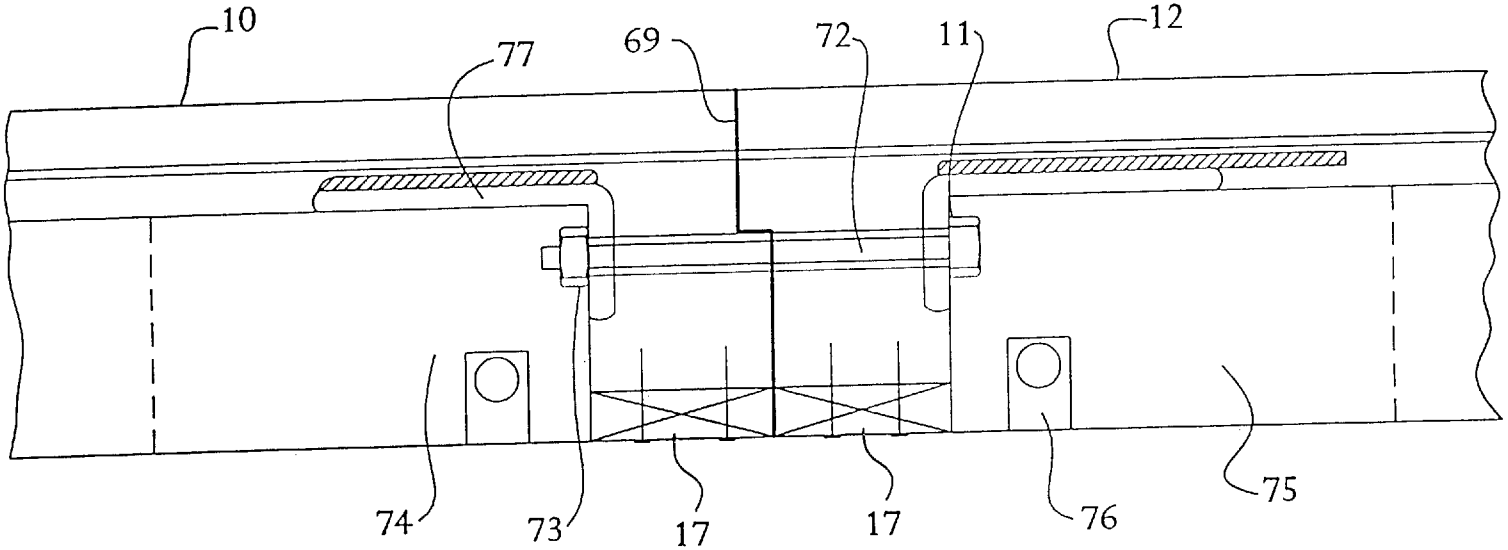
FIG. 16 is a top plan view of an adjacent panel connecting system.

One form of connection between two adjacent wall panels 10 and 12 is shown in FIG. 16. Two wall panels 10 and 12 are secured by a bolt 72 which is threaded through the respective connecting brackets 77 and fastened with a lock nut 73. A removable block of insulation 75 allows for insertion of the bolt 72. A second removable block of insulation 74 allows for placement of the nut 73. The ends of the wall panels 10 and 12 abut as shown at 69 and a bead of insulation is generally applied in-between them. For connection of adjacent and corner wall panels preferably a coiled bolt loop connection is used. A typical coiled bolt is the Dayton superior B-14 coil bolt which is used in conjunction with a B-16 coil loop insert, the bolt being a half inch by six inch bolt used in conjunction with a 13 millimeter by 150 millimeter coil loop insert. Such a construction will be known to those skilled in the art.

Figure 17:
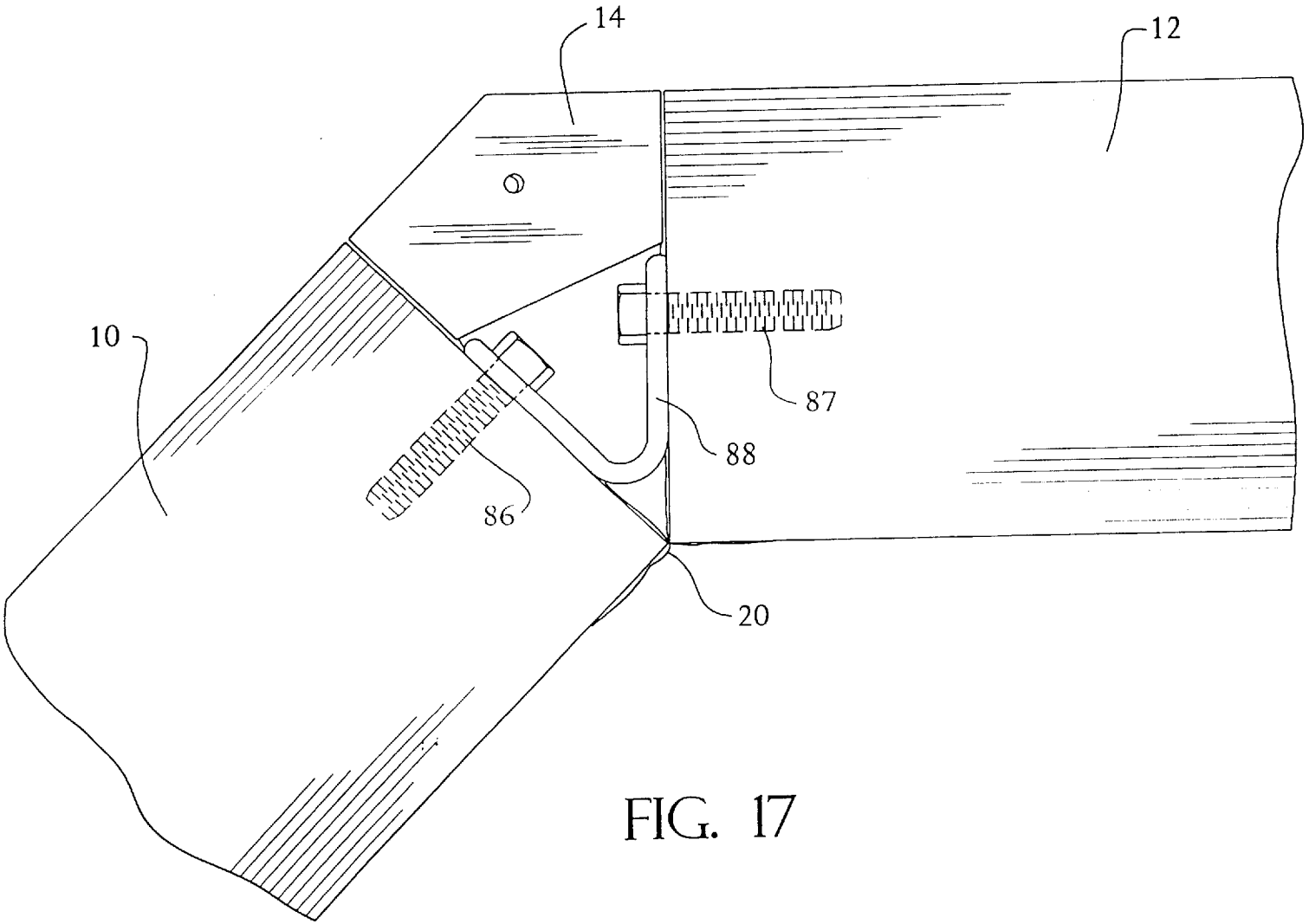
FIG. 17 is a top plan view of an angled corner piece in place.

As shown in FIG. 17, corner finishing piece 14 may be of varied shape and size. Here, the cornering wall panels 10 and 12 are abutting at an angle. The wall panels 10 and 12 are joined by V-shaped connectors 88 and the corner piece 14 finishes the exterior surface. As in the prior embodiment, straps 20 hold piece 14 in place.

Figure 18:
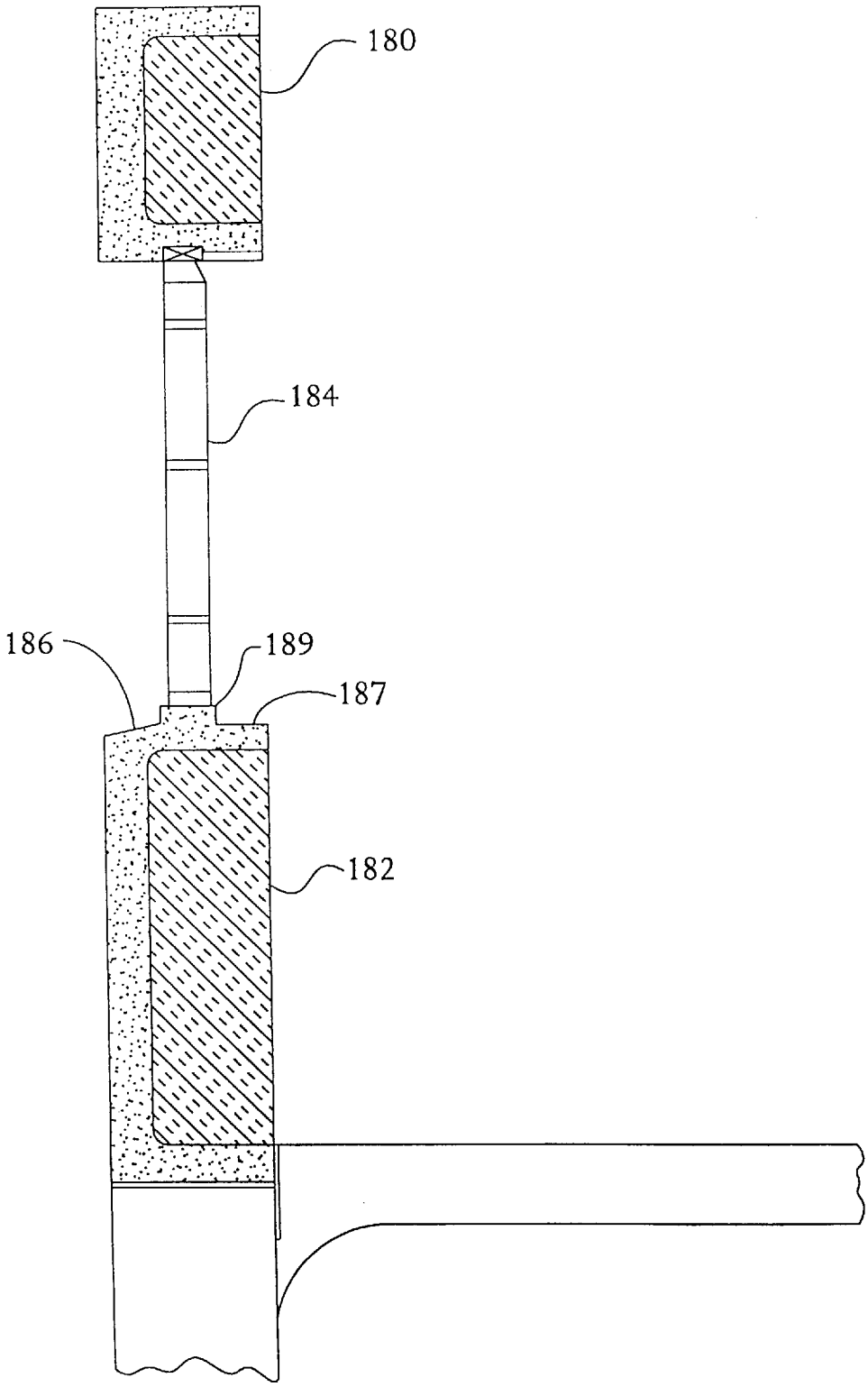
FIG. 18 is a cross-sectional view of a window opening in the wall panel.

FIG. 18 shows a window opening formed in a concrete wall panel. The concrete wall panel has upper and lower portions 180 and 182 separated by an open area sized to fit window 184. Lower portion 182 defines an outer sill 186, an inner sill 187, and a raised center 189 for placement of the window 184. The outer sill 186 is fabricated such that it slopes away from the interior of the structure, thereby inhibiting water penetration.

Although techniques for preforming concrete are known in the art, preferred methods of forming the wall panels and the non-structural corner pieces are described below.

Figure 19:
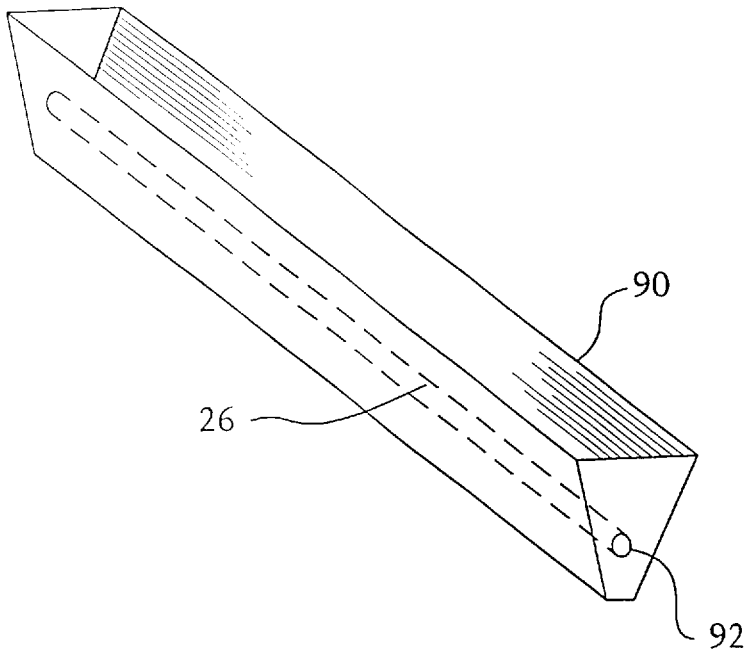
FIG. 19 is a perspective view of the corner piece form.

FIG. 19 illustrates the formation of an angular corner piece in the v-shaped form 90. Although this description is in connection with a particular shape, it will be appreciated that the shape and dimensions of the corner piece will be dictated by the panels and their interconnection. With reference to FIG. 19, a reinforcing rod 26 is suspended in the form 90 by retaining apertures 92 in the end walls of the form 90. A plurality of retaining straps 20 are secured about the rod 26 and are laid into the base of the form so as to the visible on the face of the corner piece 14 when it is cured. After the form is prepared, the concrete is poured into the form and finished in accordance with the necessary outside surface. After curing, the corner piece is removed from the form and the straps 20 are exposed on the interior face of the corner piece 14.

Figure 20:
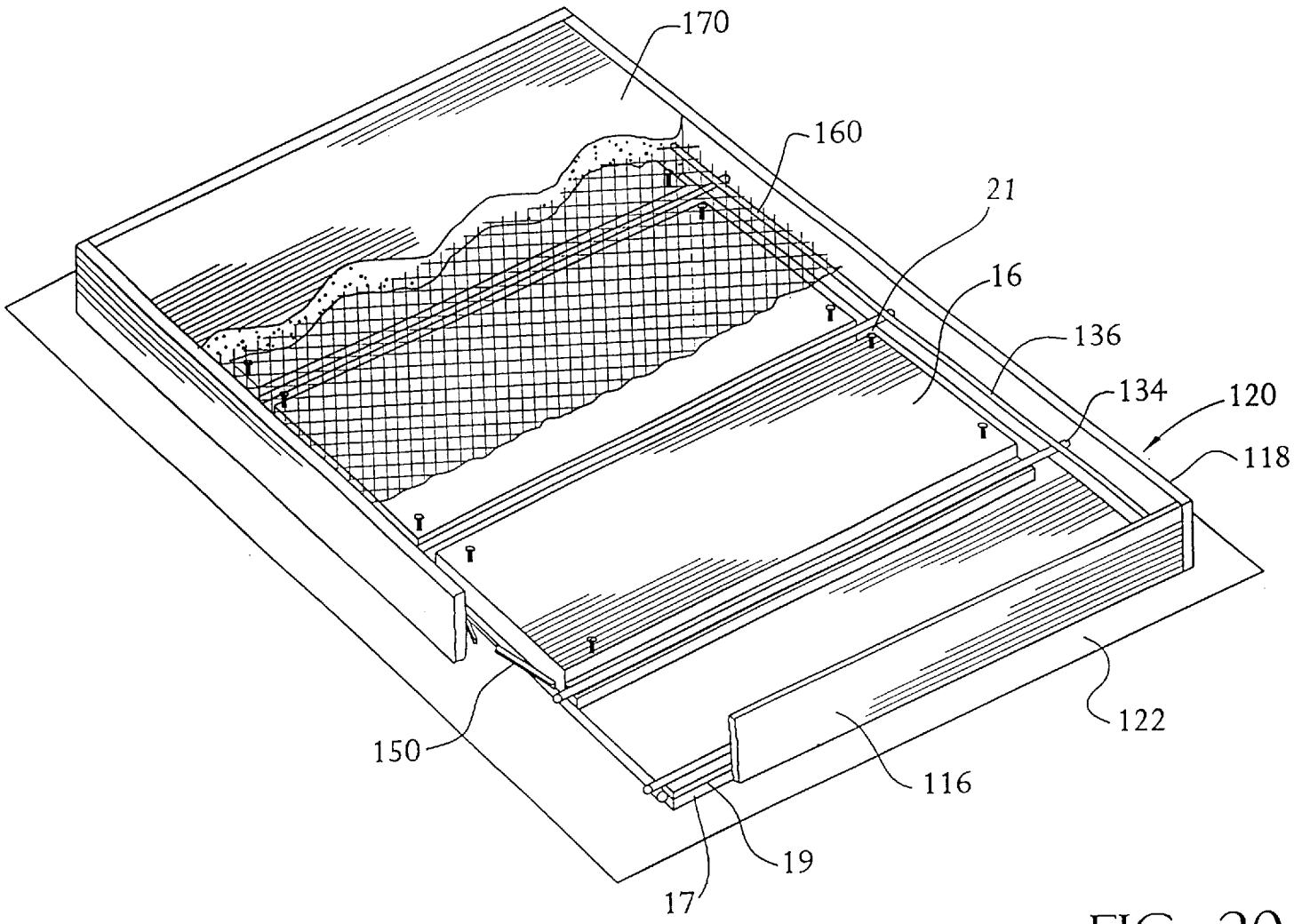
FIG. 20 is a perspective view of the wall panel form.

Referring to FIG. 20, to construct the standard wall panels described herein, forming members 116 and 118 are connected to define form 120. In the preferred embodiment, a three-quarter by three inch (¾"×3") stud 17 is laid flat in the frame so that it extends along one of the end frame members 116. Additional studs 17 are placed parallel to the first stud 17 on twenty four inch (24") centers. The final stud 17 maybe at a distance of less than twenty four inches (24") if the length of the wall dictates such. The studs 17 have a length which is less than the length of forming members 116 whereby channels 124, 126 exist at the top and bottom of the form 120.

A sheet of insulation 19 that is approximately three inches (3") wide and one-half inch (½) thick covers the interior surface of each of the studs 17. A concrete reinforcing bar 134 runs along each of the studs and is spaced at a distance from the insulation 19. The reinforcing bars 134 extend from the top of the wall to the bottom of the wall, thereby extending into the top and bottom channels 124, 126.

Four inch thick expanded polystyrene panels 16, extending the length of the studs 17, are placed between adjacent studs 17. Fasteners 21 are positioned in the panels 16 and extend therefrom. Reinforcing steel bars 136 extending the length of the wall are placed in the top and bottom channels 124, 126. Channel forms 150 are placed in the upper channel. Connecting brackets 77 can also be positioned within the form 120. Additional forming members, for example, cores to form pre-drilled holes or tubing to form electrical conduits, may be positioned in the form 120 as desired.

A wire mesh 160 is laid over the entire surface within the framing members. Conventional wet concrete 170 is poured into the form 120, filling all of the empty space within the form and providing a slab of at least two inch (2") thick concrete along the entire back of the wall. The concrete will fill the top and bottom channels and form a reinforced concrete bond beam 133 and foundation 137 thereby. The concrete fills around the fasteners 21 to secure the insulation panels 16. The channel forms 150 remain clear of concrete, leaving the trapezoid channels 30 along the top of the wall. All coil bolts and bolting angles are attached securely in the forming system leaving them embedded in the cured concrete adjacent to and overlapping reinforcement bars in the bond beam of the wall thereby forming a single unitized structure which bonds together the entire wall section.

After the concrete 170 hardens, the wall section 114 is lifted out of the form 120. This can be accomplished by attaching a lift anchor, preferably a Dayton superior swift lift P-52SL anchor, to lifting aids, such as eye bolts, which are connected to holes 135 in concrete beams 133 and 137. These holes are formed in beams 133 and 137 by the use of cores 117. Before the concrete is poured, cores 117 are set into pre-drilled holes in forming members 118 and after the concrete cures, cores 117 are tapped out to leave holes 135.

Since a form is used in the molding of panels and the corner piece, a variety of panel shapes and sizes are possible. By using proper forms, inserts, doorways and windows, including those with arch tops, can be created in panels during the forming process. The various panels can be connected to form any number of building perimeters.

The panels are preferably transported in an angle position from the site where they are formed to the construction site. This is accomplished by leaning panels against frame shape structures which are secured to a flat bed truck trailer. A lift anchor, preferably as described previously, is used to move the panels into position. The anchor is used in conjunction with a recess plug to prevent any interference of the anchor with construction of the wall panel. A universal lifting eye, such as the Dayton superior P-50SL, is used in conjunction with the anchor. For bolting the panels to the existing slab, preferably a Rawl lok bolt is used to fasten the panel.

While the present invention has been described in terms of the preferred embodiment, other variations which are within the scope of the invention as defined in the claims will be apparent to those skilled in the art.

I claim:

1. A prefabricated wall system having prefabricated wall panels which include:

a concrete base beam located in essentially a horizontal plane;

vertical concrete studs, their lengths oriented vertically and their bottom ends interlocked with and spaced along the base beam, each concrete stud including an attachment strip attached to the stud adjacent to an inside surface of the wall panel;

a concrete top beam interlocked with the top ends of the vertical studs, located in an essentially horizontal plane;

at least one geometrically configured channel in the top beam;

rigid insulation positioned between the concrete studs, the rigid insulation including a plurality of fasteners attached thereto; and a layer of concrete overlaying and uniting the base beam, vertical studs, top beam, insulation and the fasteners.

2. The prefabricated wall system of claim 1 wherein two wall panels are rigidly connected to one another to form an outside corner and the system further includes a corner finishing piece which covers the outside corner.

3. The prefabricated wall system of claim 1 wherein the wall panel channels are trapezoidal.

4. The prefabricated wall system of claim 1 wherein the panels have a horizontal dimension and the channel is angled with respect to an axis extending there along.

5. The prefabricated wall system of claim 1 further including a roof securing strap including a geometrically configured end which is positionable in and complements the geometrically configured channel.

* * * * *

UNITED STATES PATENT AND TRADEMARK OFFICE

CERTIFICATE OF CORRECTION

PATENT NO. : 5,865,001

DATED : February 2, 1999

INVENTOR(S) : Martin et al.

It is certified that error appears in the above-identified patent and that said Letters Patent is hereby corrected as shown below:

On the title page, under item [56] insert the following:

| | | | |
|---|---|---|---|
| 1,593,424 | 7/1926 | Braunworth | 52/92.1X |
| 1,657,441 | 1/1928 | Huovinen | 52/92.2X |
| 1,854,633 | 4/1932 | Stephens | 52/713X |
| 1,893,636 | 1/1933 | Ridgway | 52/653.1X |
| 1,934,760 | 11/1933 | Awbrey | 52/713X |
| 1,988,388 | 1/1935 | Mioton | 52/92.2 |
| 3,341,998 | 9/1967 | Lucas | 52/713X |
| 3,529,389 | 9/1970 | Wilkins | 52/284X |
| 3,534,515 | 10/1970 | Beed | 52/92.2 |
| 3,707,815 | 1/1973 | Molyneux | 52/713X |
| 3,818,661 | 6/1974 | Pragg | 52/282.4 |
| 3,927,498 | 12/1975 | Benedetti | 52/284X |
| 3,971,172 | 7/1976 | Gentil | 52/79.9X |
| 4,005,559 | 2/1977 | Mathou | 52/282.4 |
| 4,726,153 | 2/1988 | Adler et al. | 52/92.1X |
| 4,726,157 | 2/1988 | Hult et al. | 52/92.2X |
| 4,878,323 | 11/1989 | Nelson | 52/9232 |
| 5,357,721 | 10/1994 | Alvarez | 52/713X |
| 5,384,993 | 1/1995 | Phillips | 52/92.2 |
| 5,398,468 | 3/1995 | Erickson | 52/282.3 |
| 5,442,887 | 8/1995 | Welsh | 52/92.2 |
| 5,448,871 | 9/1995 | Newman et al. | 52/92.2X |
| 5,560,156 | 10/1996 | McDonald | 52/712X |
| 5,640,822 | 6/1997 | Haswell | 52/92.2X |

UNITED STATES PATENT AND TRADEMARK OFFICE

CERTIFICATE OF CORRECTION

PATENT NO. : 5,865,001

DATED : February 2, 1999

INVENTOR(S) : Martin et al.

It is certified that error appears in the above-identified patent and that said Letters Patent is hereby corrected as shown below:

130476 11/1932 Austria

Signed and Sealed this

Fifteenth Day of June, 1999

*Attest:*

*Attesting Officer*

Q. TODD DICKINSON

*Acting Commissioner of Patents and Trademarks*